US010215005B2

(12) United States Patent
Ayasse

(10) Patent No.: US 10,215,005 B2
(45) Date of Patent: Feb. 26, 2019

(54) MULTI-FLOW PIPE AND PIPE COUPLINGS THEREFOR FOR USE IN FRACTURE FLOW HYDROCARBON RECOVERY PROCESSES

(71) Applicant: IOR Canada Ltd., Calgary (CA)

(72) Inventor: Conrad Ayasse, Calgary (CA)

(73) Assignee: IOR Canada Ltd. (CA)

( * ) Notice: Subject to any disclaimer, the term of this patent is extended or adjusted under 35 U.S.C. 154(b) by 206 days.

(21) Appl. No.: 15/320,309

(22) PCT Filed: Jul. 2, 2015

(86) PCT No.: PCT/CA2015/000428

§ 371 (c)(1),
(2) Date: Dec. 19, 2016

(87) PCT Pub. No.: WO2016/000068

PCT Pub. Date: Jan. 7, 2016

(65) Prior Publication Data

US 2017/0145757 A1 May 25, 2017

(30) Foreign Application Priority Data

Jul. 2, 2014 (CA) ..... 2855417
Mar. 16, 2015 (CA) ..... 2885146

(51) Int. Cl.
*E21B 17/18* (2006.01)
*F16L 9/19* (2006.01)
(Continued)

(52) U.S. Cl.
CPC ..... *E21B 43/14* (2013.01); *E21B 17/042* (2013.01); *E21B 17/046* (2013.01); *E21B 17/18* (2013.01);
(Continued)

(58) Field of Classification Search
CPC ..... E21B 17/18; F16L 9/18; F16L 9/19; F16L 39/005; F16L 37/56; F16L 37/565
(Continued)

(56) References Cited

U.S. PATENT DOCUMENTS 2,494,803 A * 1/1950 Frost ..... E21B 17/18 138/114
2,850,264 A * 9/1958 Grable ..... E21B 17/10 175/69
(Continued)

FOREIGN PATENT DOCUMENTS

CA 1328254 A1 4/1994
CA 2900968 A1 8/2014
(Continued)

*Primary Examiner* — Kenneth L Thompson
(74) *Attorney, Agent, or Firm* — D. Doak Horne

(57) ABSTRACT

A dual flow/multi-flow pipe assembly for use in hydrocarbon recovery processes, having alternately-spaced apertures along a length thereof separated by packer elements, wherein alternating apertures fluidly connect with separate flow channels within the pipe assembly. A first embodiment is of a pipe-in-pipe configuration, with tubular members respectively located in alternately-spaced apertures fluidly connecting an interior pipe member with an exterior of the pipe assembly, and remaining spaced apertures fluidly connecting said exterior with an annular region between the interior pipe and the outer pipe, A second embodiment is of the divided pipe configuration, wherein a longitudinally extending divider partition is provided in each pipe member making up the multi-flow pipe assembly thereby forming two separate flow channels within each pipe member, with alternately spaced apertures fluidly communicating with a respective of the two or more flow channels formed within each pipe member by the divider partition.

18 Claims, 8 Drawing Sheets

(51) Int. Cl.

| | |
|---|---|
| ***F16L 39/00*** | (2006.01) |
| ***E21B 43/14*** | (2006.01) |
| ***E21B 43/17*** | (2006.01) |
| ***E21B 43/26*** | (2006.01) |
| ***E21B 17/042*** | (2006.01) |
| ***E21B 17/046*** | (2006.01) |
| ***E21B 33/12*** | (2006.01) |
| *E21B 43/20* | (2006.01) |

(52) U.S. Cl.
CPC ..... *E21B 33/12* (2013.01); *E21B 43/17* (2013.01); *E21B 43/26* (2013.01); *E21B 43/20* (2013.01)

(58) Field of Classification Search
USPC ..... 138/114, 115
See application file for complete search history.

(56) References Cited

U.S. PATENT DOCUMENTS 3,777,502 A * 12/1973 Michie, III ..... F16L 9/18 137/340
3,881,755 A * 5/1975 Brunato ..... E21B 7/12 138/115
4,424,859 A 1/1984 Sims et al.
4,650,367 A * 3/1987 Dietzler ..... E02B 11/00 405/43
4,770,244 A 9/1988 Webb
4,844,182 A * 7/1989 Tolle ..... E21B 7/04 175/215
4,924,949 A 5/1990 Curlett
5,125,691 A * 6/1992 Bogdan ..... E21B 17/18 138/113
5,246,070 A * 9/1993 Greve ..... E21B 17/18 166/242.3
2002/0162596 A1* 11/2002 Simpson ..... E21B 17/18 138/98
2005/0200127 A1 9/2005 Johnson et al.
2007/0089875 A1 4/2007 Steele et al.
2016/0047179 A1* 2/2016 Kjorholt ..... E21B 43/255 166/308.1
2018/0094515 A1* 4/2018 Kennedy ..... E21B 43/121

FOREIGN PATENT DOCUMENTS

WO 2011119197 A1 9/2011
WO 2011119198 A1 9/2011

* cited by examiner

MULTI-FLOW PIPE AND PIPE COUPLINGS THEREFOR FOR USE IN FRACTURE FLOW HYDROCARBON RECOVERY PROCESSES

FIELD OF THE INVENTION

The present invention relates to piping used in hydrocarbon recovery, and more particularly to multi-flow pipe and pipe couplings therefor.

BACKGROUND OF THE INVENTION AND DESCRIPTION OF THE PRIOR ART

The dual and multi-flow pipe invention herein is intended for, and adapted specifically for, use in the particular methods of hydrocarbon recovery from underground hydrocarbon formations, Specifically, the dual and multi-flow pipe members forming the subject matter of the present invention are particularly suited for the methods of hydrocarbon recovery set out and claimed in PCT patent application WO 2015/00071 and WO 2015/00072. PCT 2015/00072 in particular describes a particular method of hydrocarbon recovery which involves injection of a flushing fluid into multiple parallel alternate spaced-apart fractures along a wellbore drilled in a hydrocarbon formation, and at the same time recovering hydrocarbons from an adjacent alternately-spaced fracture(s) along such wellbore. Such methods using a single wellbore but involving two separate fluids thus require dual or multi-flow pipe capable of delivering the flushing fluid, typically under high pressure, to alternately spaced fractures along the wellbore, while at the same time being able to recover hydrocarbons draining into the wellbore from remaining spaced apart (alternately spaced) fractures and allow same to be produced to surface (hereinafter referred to as the "fracture-flow" process).

It is a difficult technical problem to design a dual or multi-flow pipe assembly comprised of individual pipe segments joined together which is capable of easy manufacture and assembly and which may be used in the fracture-flow process, but which at the same time can achieve the objectives of keeping such two fluids separate and without leakage between flow channels and/or at pipe coupling joints.

Prior art techniques for maintaining two separate fluid flows or channels within a single wellbore typically employ two separate pipe members within such single wellbore (the so called "dual tube" configuration). The "dual tube" configuration poses significant problems for packer elements capable of sealing around two separate pipe members, as well as between the pipe members and the wellbore or wellbore casing. Typically, packer elements are only adapted to seal around the circumference of a single pipe member and the wellbore, or between the single pipe member and the wellbore lining/casing. Having two separate pipe members within a wellbore introduces significant problems for the packer elements to effectively seal between each of the two separate pipe members and as well between each of the two pipe members and the wellbore. While it has been done in the prior art, the packer members are more complex and expensive to manufacture. As well, the combined cross-sectional area of the separate flow passages is generally less than for a tube-in-tube configuration, or for a single divided tube.

Applicant's commonly assigned PCT application WO 2015/00071 (corresponding to applicant's Canadian Patent Application CA 2,835,592) discloses the desirability of a multi-flow channels using one or more divider partitions for creating the separate flow channels for and within continuous tubing, thus avoiding the problem of how to effectively use and couple discrete pipe elements together when using individual segments of pipe as the production piping. To be clear, applicant's PCT application WO2015/00071 makes no disclosure of how to couple pipe members together without leakage, nor how to ensure flow passages carrying separate fluids stay aligned when the individual pipe segments are coupled together.

The below provided background information and description of prior publications is provided for the purpose of making known information believed by the applicant to be of possible relevance to the present invention relating to a pipe-in-pipe configuration and a single divided pipe. No admission is necessarily intended, nor should be construed, that any of the below publications and information provided constitutes prior art against the present invention.

U.S. Pat. No. 1,781,091 entitled "Pipe Joint" teaches the concept of joining single-flow pipe members using a left hand and right hand reverse thread in the coupling collar, with a buttress joint, as shown in FIG. 4 thereof, to allow the pipe joint to transmit torque in both directions It makes no disclosure as to how such coupling could be adapted for dual or multi-channel pipe assemblies.

U.S. Pat. No. 4,397,484 entitled "Locking Coupling System" teaches a coupling system having two pipe members, each having significantly different pitched threads, one "coarser" than the other, and a "spleened" (sic) coupling with includes two coupling halves each having spleened (sic) ends adapted to lock into each other.

U.S. Pat. No. 3,680,631 entitled "Well Production Apparatus", teaches inter alia tubing or other pipe which is provided with a vacuum chamber within such pipe, to allow producing a warm fluid through the centre of the pipe when the pipe/wellbore passes through a zone of permafrost.

U.S. Pat. No. 2,204,392 entitled "Hose and Pipe Coupler" teaches same, and in particular teaches a coupler with a series of grooves or indentations 9, 10 or alternatively 8*a*, which provide alignment of the two separate halves in order to effect coupling.

U.S. Pat. No. 1,583,126 entitled "Leakage Tight Joint" teaches a pipe coupling for a pair of pipe members, having a coupling nut "a" with different sized and "handed" threads, and a packing ring "c' of softer material.

U.S. Pat. No. 2,913,261 entitled "Tube Couplings" teaches a pair of exteriorly threaded elements secured to the pipe or tube ends respectively, upon which the coupling members are rotatable into abutting relation. The threads of each element run in opposite directions from each other, and have alternately arranged or staggered lugs to prevent relative rotation when brought into engagement. No apparatus for coupling of co-axial dual flow or multi-flow pipe is disclosed.

U.S. Pat. No. 3,015,500 entitled "Drill String Joint" teaches a pair of frusto-conical threads at opposite ends of pipe members which are desired to be coupled together, having an overlying sleeve member 68.

U.S. Pat. No. 3,762,745 entitled "Connection Members with High Torque Carrying Capacity", similar to U.S. Pat. No. 4,397,484 above, teaches an externally threaded tubular member, having a pair of threads thereon of different pitch, as well as some additional tooth members for assisting in transmitting torque, and an alignment means for aligning the teeth (locking means) for engagement.

U.S. Pat. No. 861,828 entitled "Pipe Coupling" teaches a male coupling member C, having an internal and an external thread thereon, and a complementary female coupling member D, having a pair of internal threads thereon, as shown in the sole figure thereof. No means of coupling a co-axial pipe is disclosed, or any manner of supporting a co-axial pipe therein.

U.S. Pat. No. 572,124 entitled "Insulated Joint for Light Fixtures", insofar as may be said to be relevant to the present invention, teaches a joint having upper and lower tubular connecting sections A, C, and an insulating section E.

Finally, U.S. Pat. No. 3,943,618 entitled "Method of Assembly of a Dual-walled Pipe" teaches an outer pipe 1 with a concentric inner pipe 2 defining annulus 3 therebetween. The pipes 1,2 having connector means 32 associated with first pipe are rigidly maintained in this spaced-apart relation by means of connector means 4, 5. FIG. 4 thereof shows an embodiment where inner pipe 20 and outer pipe 21 are connected by way of connector means 22 in a threaded manner, outer pipe 21 having a collar 23 also threaded thereto. Threads 24 between outer surface of pipe 20 and the inner surface of connector means 22 are tapered, wherein thread 25 between the inner surface of pipe 21 and the outer surface of connector means 22 are straight. FIG. 5 shows an embodiment where the second pipe 31 has threads of opposite rotational direction at its opposing ends.

Despite the above prior art, a need exists for a dual or multi-flow pipe assembly using discrete pipe segments, which can be easily manufactured at relatively low cost and further easily joined together in the field and which effectively operates to maintain separate flows of fluid therewithin without leakage.

SUMMARY OF THE INVENTION

The present dual-flow/multi-flow pipe assembly advantageously eliminates the need to drill two separate wellbores to accomplish flushing of alternate fractures in a wellbore and simultaneously recover hydrocarbons that are driven from the formation into adjacent fractures by the flushing fluid (i.e. the "fracture-flow" process). The present dual-flow/multi-flow pipe assemblies of the present invention thereby saves the cost of having to drill a separate well.

While the cost of dual-flow/multi-flow piping of the type described and claimed herein may be more expensive than that of single flow pipe assemblies due to slightly more complex manufacturing methods for such multi-flow pipe as described herein [although from a point of view of actual pipe material, a pipe-in-pipe configuration for a dual-flow pipe assembly as described herein is approximately equal to the quantity of material for two separate pipes strings], advantageously the dual flow/multiflow pipe of the present invention can be removed from a formation once such formation has been worked through to exhaustion, and subsequently later re-used in working another hydrocarbon formation. In comparison, however, the capital cost of drilling two separate wells is a "sunk" cost and is forever lost and not capable of being recouped. Multi-flow piping of the type hereinafter disclosed can accordingly provide clear cost advantages.

In order to provide a dual flow or multi-flow pipe assembly useful for the purposes set out herein, in a first broad aspect of the present invention, the present invention provides a dual-flow pipe assembly which when a plurality thereof are coupled together in end-to-end relation allows delivery downhole of a first fluid to a hydrocarbon-containing formation and collection from the formation of a separate second fluid while maintaining separate therewithin said first fluid from said second fluid.

In such first broad embodiment each dual-flow pipe assembly comprises:

(i) an outer cylindrical hollow pipe member, having a threaded portion at opposite ends thereof for threaded coupling to another outer pipe member;

(ii) an inner cylindrical pipe member having a hollow bore, said inner pipe member situated, preferably co-axially, within said outer pipe member so as to form an annular region between an exterior of said inner pipe member and an interior surface of said outer hollow pipe member, said inner cylindrical pipe member having at mutually opposite ends thereof connecting means to sealingly engage and/or connect to another inner pipe member;

(iii) a plurality of apertures in a periphery said outer pipe member, situated in spaced-apart relation along at least a portion of a length of said outer pipe member, providing fluid communication between an exterior of said outer pipe member and said annular region;

(iv) a packer element encircling said outer pipe member about said periphery of said outer pipe member and positioned on said periphery between a pair of said plurality of apertures; and (v) at least one tubular member, situated within at least one of said spaced-apart apertures, affixed at one end thereof to said periphery of said outer pipe member and affixed at another mutually opposite end to said inner pipe member and spanning in a radial direction said annular region and providing fluid communication between said exterior of said outer pipe member and said bore of said inner pipe member.

In a preferred refinement of the above first embodiment of the dual-flow pipe assembly, such dual-flow pipe assembly comprises a plurality of said tubular members, located in alternately-spaced apertures of said plurality of apertures, along substantially a length of said outer pipe member of said dual flow pipe assembly. Such tubular members then fulfill the function of supporting and fixedly retaining the inner pipe member, preferably centrally, within the outer pipe member.

In a still-further refinement, to allow ease of manufacture in installing and fixedly securing the tubular members to the inner pipe member and further securing them to the outer pipe member at the location of the apertures in the outer pipe members, at least some of the alternately-spaced apertures in the periphery of the outer pipe member are threaded, and at least some of said tubular members are threadably coupled to said interior pipe member via threaded insertion in respective of said threaded alternately-spaced apertures. The tubular members may further be welded, at an opposite extremity thereof, to the outer pipe member.

Advantageously, pipe members comprising an outer and inner member of the "pipe-in-pipe" configuration may be manufactured using the above method, and thereafter sealingly coupled together. In such manner the tubular members may then allow flushing fluid to be provided at desired locations along a dual-flow pipe assembly/wellbore. Such tubular members advantageously then serve to fixedly locate the inner pipe member within the outer pipe member, without, to any substantial degree, obstruction of fluid flow in the annular region between the inner and outer pipe members. A flushing fluid may thus be effectively delivered, via the tubular members forming part of the dual flow pipe assembly of the present invention, to fractures in the hydrocarbon formation. Hydrocarbons which flow into the annular region of the dual-flow pipe assembly via the alternately spaced apertures in the periphery of the outer pipe members may then be produced to surface.

Alternatively, of course, since in most embodiments it will makes no difference to the hydrocarbon recovery method, the annular region of the dual flow pipe assembly may be used to deliver the flushing fluid to the alternately-spaced apertures. In such method of employment of the dual flow pipe assembly, the tubular members are then used to collect the hydrocarbons flushed from the formation in the inner pipe member, and the contents of the inner pipe member continually produced to surface.

In a preferred embodiment, the threaded portion on the outer pipe member at one end thereof comprises an externally threaded portion.

In a further preferred embodiment, the threaded portion on the outer pipe member at a mutually opposite other end thereof comprises an internally threaded portion.

In a preferred embodiment, to assist in sealing at the junction of individual outer pipe members, and to avoid the potential need for a sealing gasket when coupling of outer pipe members together, each of the threaded portions on the outer pipe members comprises a frusto-conical thread. In such manner, sealing of the threaded unions is increased.

Similarly, to assist in sealing at junctions of individual inner pipe members, and to likewise possibly avoid the need for a sealing gasket each of the externally threaded portion and said internally threaded portion on the inner pipe members in such embodiment also possess a frusto-conical thread.

In an embodiment wherein each end of each outer pipe member (i.e. said one end and the mutually opposite other end) comprises an externally threaded portion, a coupling collar having a pair of internal, mutually oppositely threaded, conical threaded portions, configured to threadably engage each of said external threads on respective opposite ends of said outer pipe member, may be provided. In such embodiment, rotation of the coupling collar in a first direction conveniently draws together said ends of said outer pipe members to thereby retain the outer pipe members together. Sealing may further be effected by providing a gasket intermediate ends of the outer pipe members, which gasket is compressed upon rotation of the coupling collar in the first direction. Alternatively, or in addition frusto-conical threads may be utilized to further assist in ensuring absence of leakage of either the flushing fluid or collected hydrocarbons from either the inner pipe members or the outer pipe members.

In a further refinement of the invention wherein the aforesaid coupling collar is provided to couple the outer pipe members together, matingly-engageable splines at each end of the outer pipe members are provided, wherein rotating the coupling collar in said first direction draws together said ends of said outer members and further causes mating engagement of said splines so as to rotatably lock one of said dual-flow pipe members relative to another of said dual-flow pipe members. Such allows rotation of a dual-flow pipe assembly which forms a production string to be rotated in either direction (instead of only being able to rotate same in a single direction) without unscrewing the outer pipe members from the respective coupling collars.

The connecting means on the inner pipe members may comprise helically threaded portions on mutually opposite ends of each inner pipe member.

Alternatively, the connecting means on the inner pipe members may comprise a gasket member which is compressed between opposite ends of a pair of said inner pipe members when pipe members are coupled together.

Still further alternatively, the connecting means on the inner pipe members may comprise mutually overlapping ends of a pair of said inner pipe members.

The present invention, in an alternative configuration thereof, comprises a multi-flow pipe assembly, which comprises a series of single pipe members coupled together, each pipe member having one or more divider partition(s) welded therein, thereby creating two or more separate flow channels within each single pipe member. The difficulty in forming a multi-flow pipe assembly comprising a series of such pipe members is being able to couple such pipe members together in a manner that avoids leakage between pipe members at the point of coupling, but which further ensures that the flow channels are in communication between individual pipe members so as to ensure fluids travelling within such multi-flow pipe assembly are maintained separate and do not co-mingle at unions between pipe members.

In such configuration, due to being able to provide multiple divider partitions, more than two flow channels may be created in each pipe assembly. Again, however, in coupling pipe members together, it is problematic to ensure not only no leakage at the junction between such pipe members, but further that each channel in one pipe member is aligned with the corresponding flow channel in an adjoining coupled pipe member.

Accordingly, in this embodiment/aspect of the present invention, a plurality of cylindrical multi-flow pipe members threadably coupled together in end-to-end relation to form a multi-flow pipe assembly, for delivering downhole a first fluid to a hydrocarbon-containing formation and collecting from the formation a separate second fluid, are provided.

Such pipe members each maintaining separate therewithin said first fluid from said second fluid, and when coupled allow each flow channel to communicate with the corresponding flow channel of a coupled pipe member.

In such multi-flow pipe assembly, each pipe member has a longitudinal hollow bore extending substantially a length thereof, and extending throughout said bore at least one substantially flat divider partition, said divider partition dividing said bore longitudinally into a first flow passage and a second separate flow passage.

A first plurality of apertures are provided in an outer periphery of said multi-flow pipe assembly, situated along at least a portion of a length of said multi-flow pipe assembly, and which when said pipe members are coupled together provide fluid communication between an exterior of said multi-flow pipe assembly and said first flow passage.

A second plurality of apertures in said outer periphery of said multi-flow pipe assembly, alternately spaced with said first plurality of apertures in and longitudinally along said outer periphery, are provided. Such second plurality of apertures provide fluid communication between an exterior of said multi-flow pipe assembly and said second flow passage.

Packer elements encircle said outer periphery of said multi-flow pipe assembly, and are positioned between respective pairs of first apertures and second apertures.

Importantly, alignment means, situated at opposite ends of each of said pipe members, adapted to engage corresponding mating alignment means at an opposite end of another pipe member when said pipe members are in end-to-end abutting relationship and ensure said divider partition in each of said pipe members is in substantial coplanar relationship with an adjacent of said divider partition of another pipe member coupled thereto, are provided. Such alignment means may take the form of a pair of dowel members extending from one end of a pipe member, with mating apertures for such dowel members being provided at an opposite end of such pipe members, which dowel members only become aligned with their respective apertures upon the divider partition(s) of that pipe member, and the corresponding fluid flow passages, being aligned and coplanar with the corresponding fluid flow passages of another pipe member to which said first pipe member is being coupled.

The alignment means take the form of a notch in the periphery of the pipe member, at one end thereof, adapted to matingly engage a corresponding protuberance provided at a mutually opposite end of each pipe member. In such configuration, the aperture and protuberance are only aligned for engagement upon the divider partition(s) of that pipe member, and the corresponding fluid flow passages, being aligned and coplanar with the corresponding fluid flow passages of another pipe member to which said first pipe member is being coupled.

Other alignment means for achieving the above purpose will now occur to persons of skill in the art. Such alignment means form part of the invention recited herein.

Lastly, couplings means, at mutually opposite ends of each of said pipe members, which, in combination with said mating alignment means, draw together mutually opposite ends of said pipe members such that said divider partition in each of said pipe members abuts and is in substantially coplanar relationship with, said divider portion of another pipe member coupled thereto.

In a preferred embodiment, opposite "handed" threads are provided on the opposite ends of each pipe member which allows the coupling collar, when rotated in one direction, to draw opposite ends of the pipe members of the multi-flow pipe assembly together in sealing engagement. Accordingly, in such further embodiment/refinement, the coupling means comprises:

an externally threaded portion situated at mutually opposite ends of each of said pipe members, each of said externally threaded portions on each pipe member being mutually oppositely threaded; and a plurality of coupling collars, having a pair of internal, mutually oppositely threaded, portions, configured to threadably engage each of said external threads on opposite ends of said pipe members, such that rotation of said collars in a first direction draws together respective of said ends of a pair of said outer pipe members and further causes mating engagement of said mating alignment means to prevent relative angular rotation between coupled pipe members.

In a further refinement, the externally threaded portions on each of said pipe members are frusto-conical, and the internal threaded portions on each of said coupling collars are correspondingly frusto-conical in shape.

In a further alternative embodiment, an externally threaded portion on one end of each of said pipe members. A plurality of coupling collars, journalled for rotation at respective of said opposite ends of said pipe members, and further having an internally threaded portion therein, are provided. In such embodiment, when said externally threaded portion at said one end of each of said pipe members abuts said mutually opposite end of said pipe members when same are coupled in end-to-end relation, said alignment means matingly engages said corresponding mating alignment means at an opposite end of another pipe member said coupling collar can be rotated so as to threadably engage said external threaded portion on said one end of said pipe members and retain said pipe members together.

In each of the various above embodiments a sealing gasket may be interposed between each pipe member, said sealing gasket configured to prevent leakage of fluid from said first flow passage to said second flow passage and vice versa when said pipe members are coupled together.

BRIEF DESCRIPTION OF THE DRAWINGS

Further advantages and permutations and combinations of the invention will now appear from the above and from the following detailed description of the various particular embodiments of the invention, taken together with the accompanying drawings each of which are intended to be non-limiting, in which.

DETAILED DESCRIPTION OF SOME PREFERRED EMBODIMENTS

Figure 1:
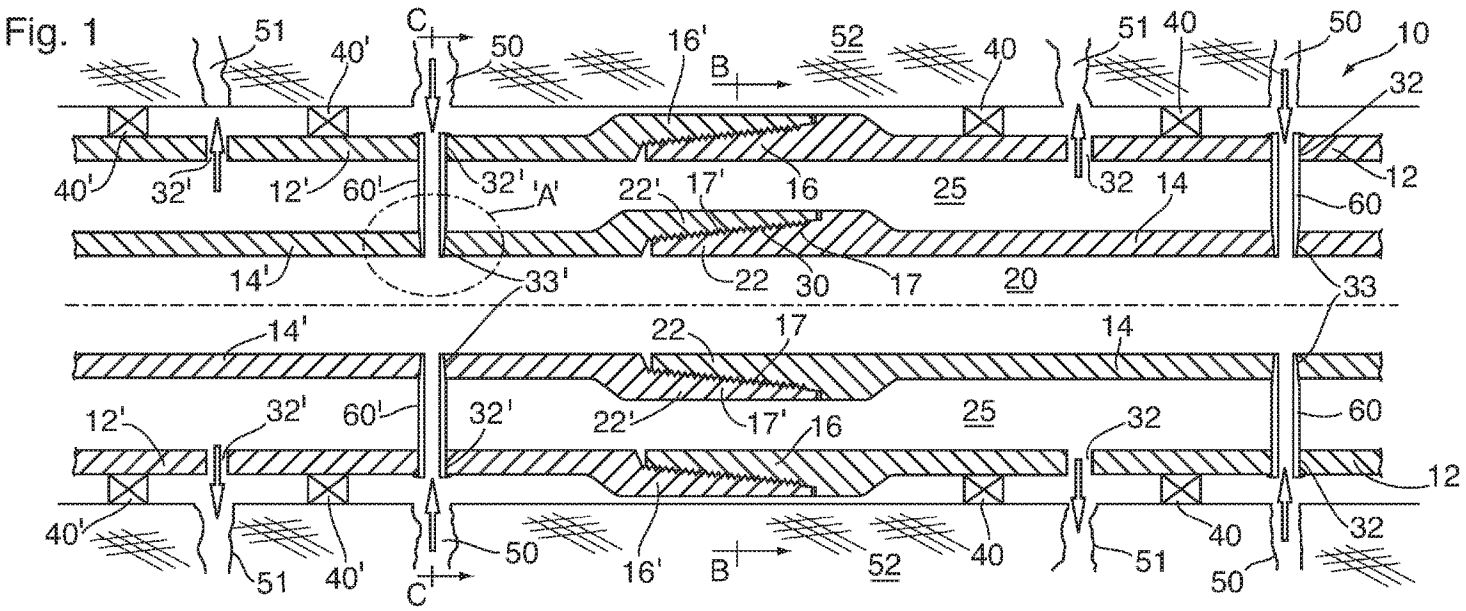
FIG. 1 is a cross-sectional view of a first embodiment of a multi-flow (in this case dual flow) pipe assembly of the "pipe-in-pipe" configuration, taken through a pair of pipe assemblies when coupled together.

In the following description, similar components in the drawings figures are identified with corresponding same reference numerals.

FIG. 1 shows a cross-sectional view of a dual-flow pipe assembly 10, being the first embodiment of the present invention, namely a dual-flow pipe assembly 10 of the "pipe-in-pipe" configuration, having a plurality of outer pipe members 12, 12' and inner pipe members 14, 14' coupled together in end-to-end relation.

Outer cylindrical hollow pipe members 12 has a threaded portion 16 at opposite ends thereof for threaded coupling to another outer pipe member 12' likewise having corresponding threaded portions 16'. Threaded portion 16 is externally threaded and preferably of frusto-conical shape, while mating threaded portion 16' is internally threaded and likewise also of frusto-conical shape for better fluid sealing upon engagement of threaded portion 16 with mating threaded portion 16'.

Inner cylindrical pipe member 14 is provided, having a hollow bore 20, situated, preferably co-axially as shown, within outer pipe member 12 so as to form an annular region 25 between an exterior of inner pipe member 14 and an interior surface of outer pipe member 12. Inner pipe member 14 has, at mutually opposite ends 22, 22' thereof, connecting means 30 to sealingly engage and/or connect to another inner pipe member 14'.

Connecting means 30, in the embodiment shown in FIG. 1, comprises threaded portion 17 at end 22 of inner pipe member 14, for threaded coupling to end 22' of another inner outer pipe member 14' likewise having corresponding threaded portions 17'. Threaded portion 17 is externally threaded and preferably of frusto-conical shape, while mating threaded portion 17' is internally threaded and likewise also of frusto-conical shape for better fluid sealing upon engagement of external threaded portion 17 with mating internal threaded portion 17'.

A plurality of apertures 32, 32' are respectively provided in a periphery of outer pipe members 12, 12', in spaced-apart relation along a respective length of outer pipe members 12, 12'.

Packer elements 40, 40' are provided which encircle respective outer pipe members 12, 12' on dual-flow pipe assembly 10. Each packer element 40, 40' is positioned between a respective pair of apertures 32, 32', as shown in FIG. 1, in order that a seal be created between the wellbore and the dual-flow pipe assembly 10 and to keep separate hydrocarbons which flow into fractures 50 from hydrocarbon formation 52 and thence into dual-flow pipe assembly 10 from fluids being injected into alternately-spaced fractures 51.

Figure 1C:
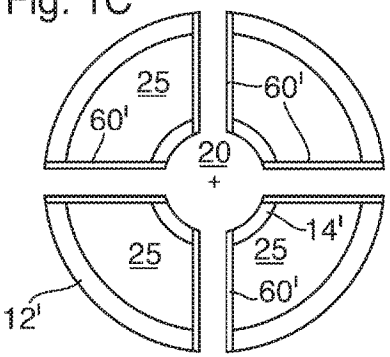
FIG. 1C is a view taken along section C-C of FIG. 1.
Figure 1B:
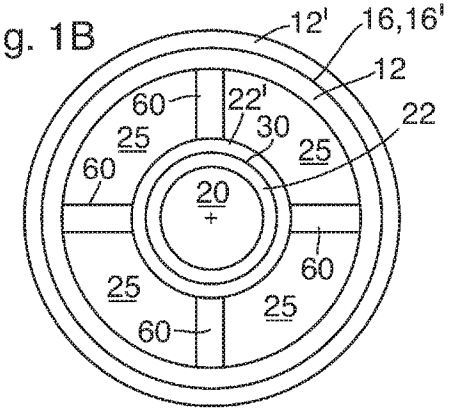
FIG. 1B is a view taken along section B-B of FIG. 1.
Figure 1A:
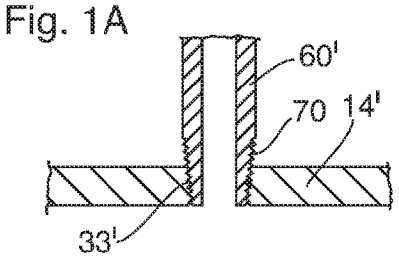
FIG. 1A is an enlarged view of region "A" in each of FIGS. 1, 2, 3 & 4.

Tubular members 60, 60' are situated within alternately-spaced apertures 32, 32' respectively, as shown in FIG. 1, in order that hydrocarbons flowing into fractures 50 and thence into dual-flow pipe assembly 10 via tubular members 60, 60' may be collected within bore 20 of inner pipe member 14 via such tubular members 60, 60', so as to then be produced to surface. Tubular members 60,60" are affixed at one end thereof to outer pipe member 12, and affixed at another mutually opposite end to inner pipe member 14 and span annular region 25 in a radial direction, as best shown in FIGS. 1A, 1B and 1C.

In addition to providing fluid communication, in a preferred embodiment tubular members 60, 60' further fixedly support and fixedly retain inner pipe member 14 within outer pipe members 12, 12'. In one embodiment this may be done by providing threads 70 at one end of each of such tubular members as shown in FIG. 1A, to allow such tubular members 60, 60' to be threadably inserted in similarly threaded apertures 33, 33' in inner pipe members 14, 14', by inserting such tubular members 60, 60' through respective alternately-spaced apertures 32, 32' in outer pipe members 12, 12', when inner pipe members 14, 14' are respectively inserted within outer pipe members 12, 12'. Thereafter, tubular members 60,60' may be welded to respective outer pipe members 12, 12', as best shown in FIG. 1C to complete the securement of the tubular members and thus the securement of inner pipe members 14, 14' within outer pipe members 12, 12'.

Threadable coupling of outer pipe members 12, 12' simultaneously results in threaded coupling of inner pipe members 14, 14' resulting in dual-flow pipe assembly 10.

While FIG. 1 shows tubular members 60,60' collecting hydrocarbons and thus inner pipe member 14 producing to surface, with flushing fluid being provided to alternately spaced apertures 32, 32', the invention contemplates that the process may be reversed, wherein the tubular members 60, 60' may alternatively supply flushing fluid, with remaining alternately spaced apertures 32, 32' collecting hydrocarbons flowing into dual-flow pipe assembly, and collecting same in annular region 25 and then producing same to surface.

Figure 2:
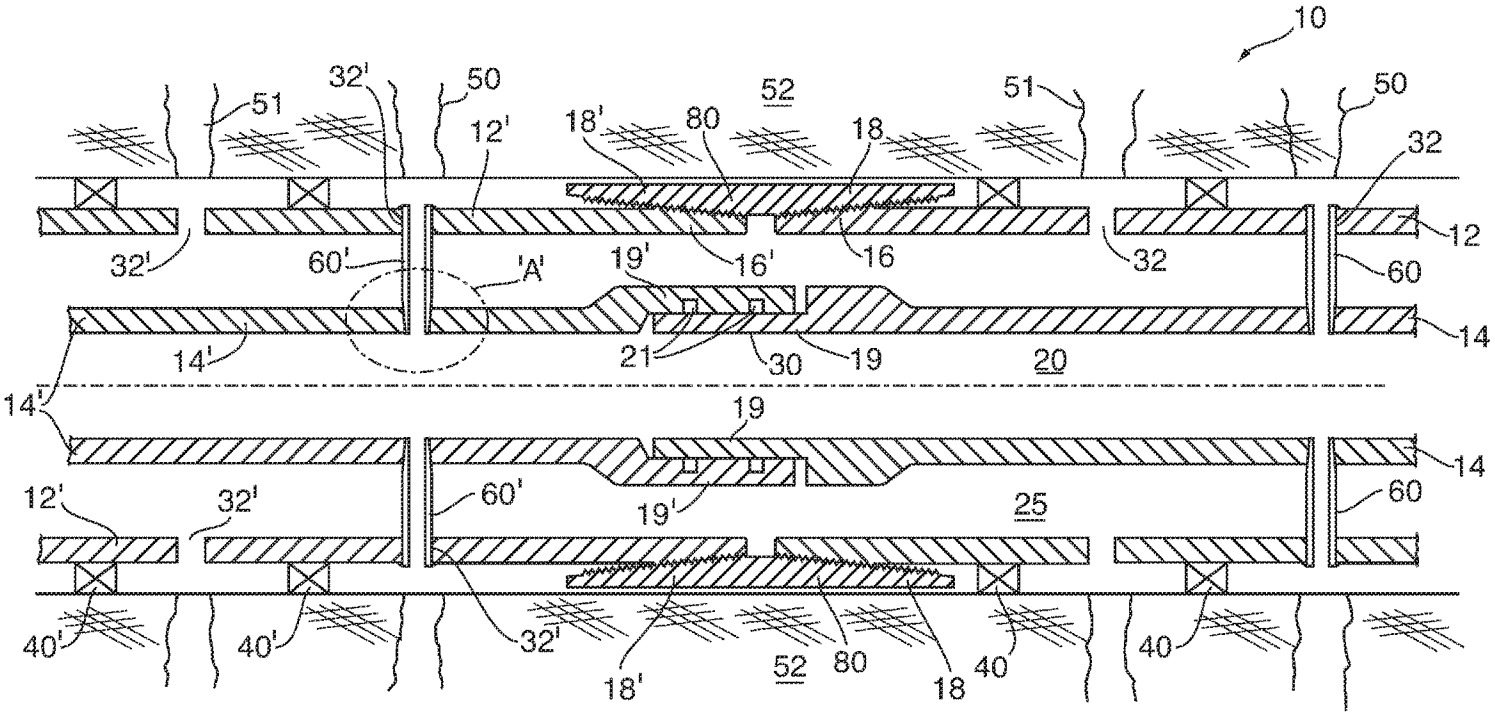
FIG. 2 is a cross-sectional view of a further embodiment of a multi-flow (in this case dual flow) pipe assembly which employs co-axial pipe members, taken through a pair of multi-flow pipe assemblies when coupled together.

FIG. 2 shows an alternative embodiment of the "pipe-in-pipe" configuration for the dual-flow pipe assembly 10 of the present invention.

In such alternative embodiment the threaded portion 16, 16' on each of outer pipe members 12, 12' each comprise an external thread, preferably of frusto-conical shape as shown in FIG. 2.

A coupling collar 80 is provided, having a pair of internal, mutually oppositely (i.e. right handed and left handed) threaded portions 18, 18', which are configured to threadably engage respectively external threads 16, 16' on respective opposite ends of outer pipe members 12, 12'. Rotation of coupling collar 80 in one direction draws together ends outer pipe members 12, 12' to effect coupling thereof.

In such embodiment the connecting means 30 at mutually opposite ends of inner pipe members 14, 14' comprise overlapping ends 19, 19', and one or more "O" ring seals 21 to ensure a sealing engagement, as shown in FIG. 2.

In such embodiment, due to the fixed coupling of inner pipe members 14, 14' to outer pipe members 12, 12' via respective tubular members 60, 60' as hereinbefore described, rotation of coupling collar 80 draws both outer pipe members 12, 12' and inner pipe members 14, 14' together thereby effecting coupling of such pipe members to form dual-flow pipe assembly 10.

Figure 3:
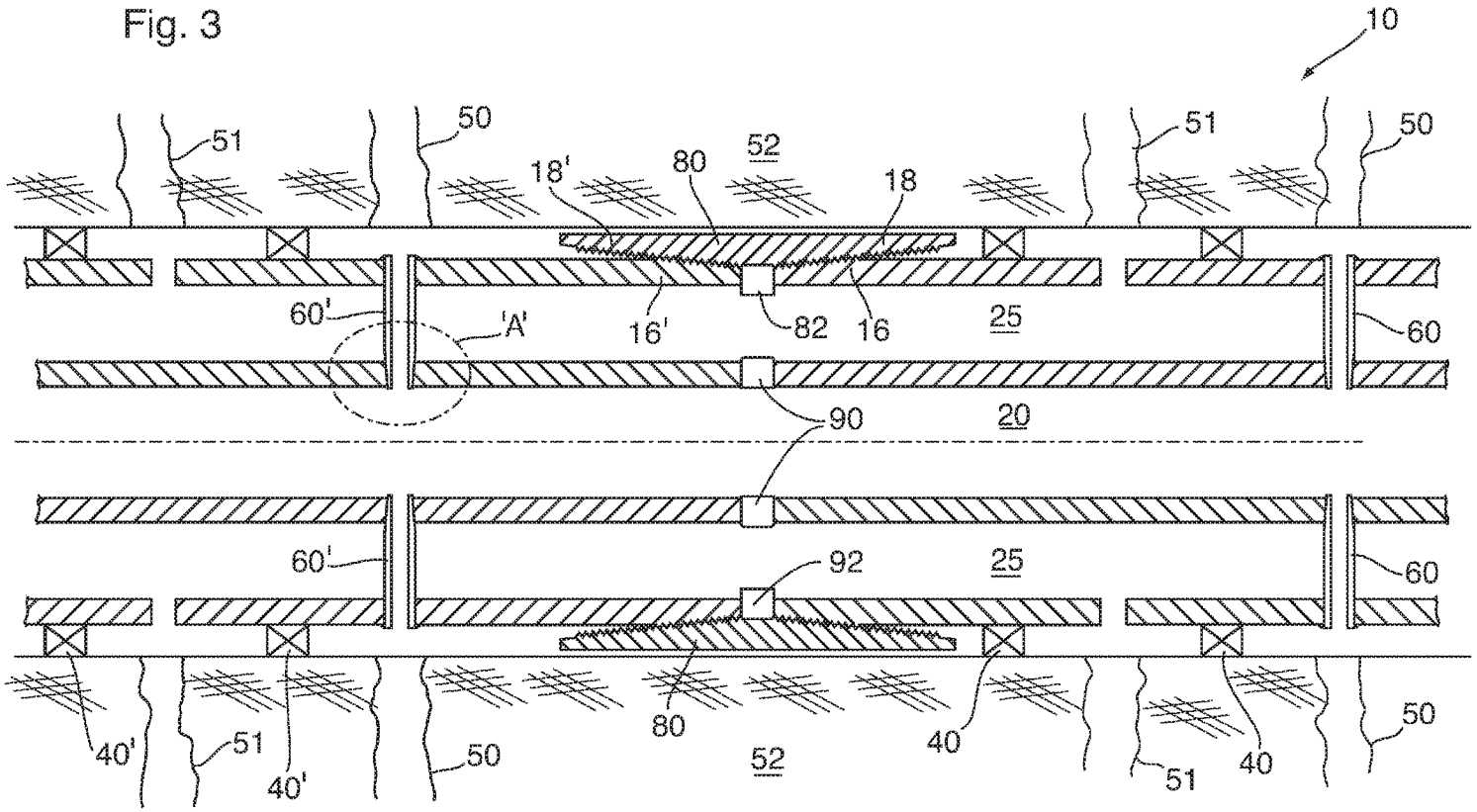
FIG. 3 is a cross-sectional view of a still-further embodiment of a multi-flow (in this case dual flow) pipe assembly which employs co-axial pipe members, taken through a pair of multi-flow pipe assemblies when coupled together.

FIG. 3 is an embodiment similar to that depicted in FIG. 2, save and except that the connecting means between each of inner pipe members 14, 14' comprises a gasket member 90 of an elastomeric material, which conforms to the circular cross-sectional profile of inner pipe members 14, 14' as best shown in FIG. 1C. A similar gasket member 92 may further be provided around circular cross sectional profile of outer pipe members 12, 12' at respective ends thereof, to further enhance, in addition to the provision of frusto-conical thereas 16, 16' and 18, 18'.

Rotation of coupling collar 80 draws both outer pipe members 12, 12' and inner pipe members 14, 14' together, compressing gasket members 90, 92, and thereby effecting sealingly coupling such pipe members together to form dual-flow pipe assembly 10.

Figure 4:
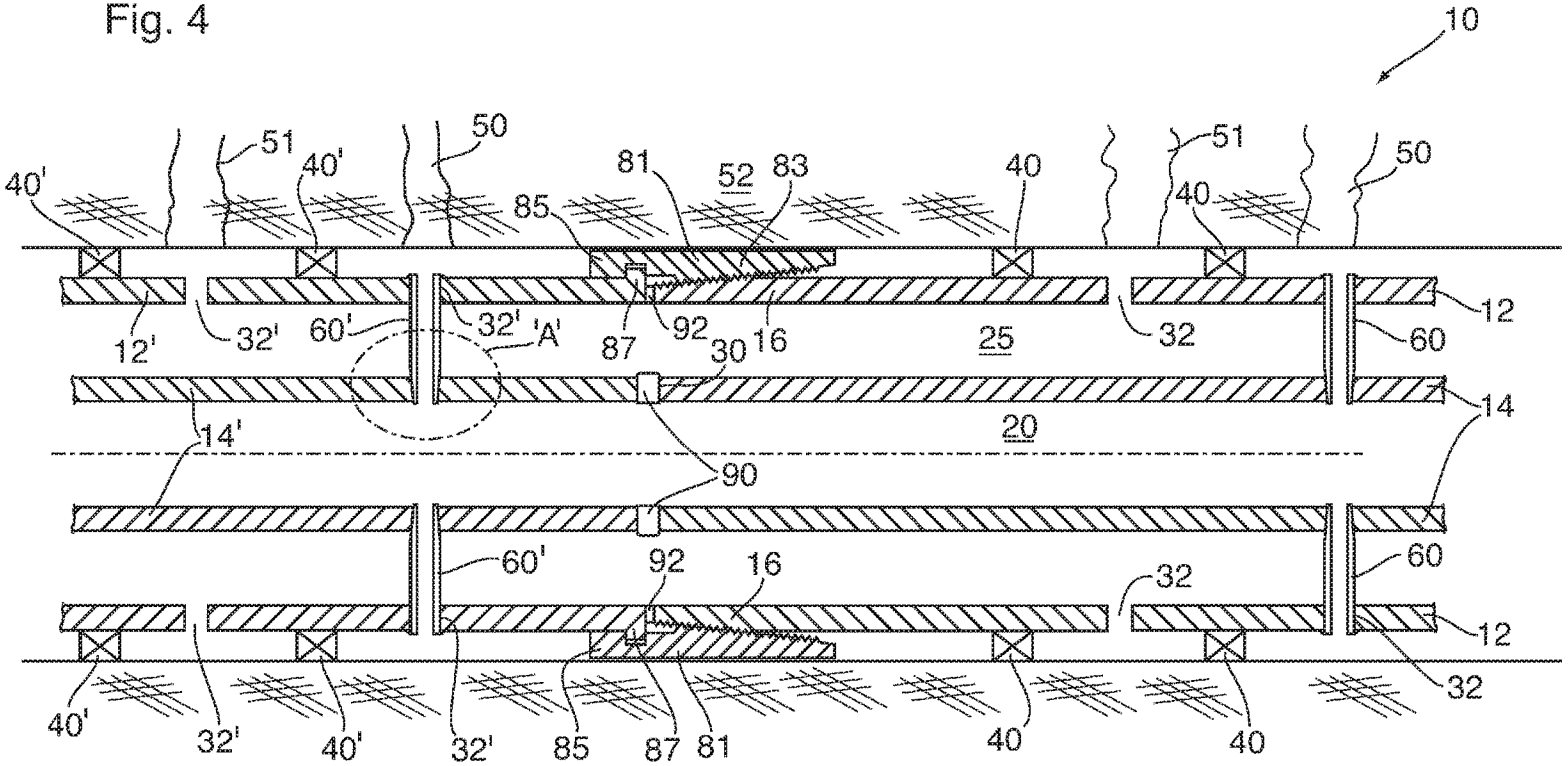
FIG. 4 is a cross-sectional view of a still further embodiment of a multi-flow (in this case dual flow) pipe assembly which employs co-axial pipe members, taken through a pair of multi-flow pipe assemblies when coupled together.

FIG. 4 shows a further variation of the "pipe in a pipe" embodiment, with a somewhat different means of coupling two ends of outer pipe members 12, 12' together. One end of each of outer pipe members 12, 12' possesses an external threaded portion 16, 16'(only pipe number 12, and external thread 16 shown in FIG. 4). At the other end of each of outer pipe members 12, 12' opposite said threaded end possesses a coupling collar 81. As seen from FIG. 4, coupling collar 81 at said other end of outer pipe member 12' is provided with an internal threaded portion 83, configured to threadably engage external thread 16 on outer pipe member 12. Coupling collar 81 is retained at said other end of outer pipe members 12, 12' by means of a internal ring member 85 engaging an external ring member 87 on outer pipe members 12, 12'. Coupling collar will necessarily need to be welded with internal ring member 85 at each end of outer pipe members 12, 12'. Rotation of collar 81 in a first direction draws together said ends of said outer pipe members 12, 12', and likewise simultaneously draws together ends of inner pipe members 14, 14' in sealing engagement, thereby forming the integral dual flow pipe assembly 10. In the embodiment shown in FIG. 4, the connecting means 30 between the inner pipe members 14, 14' is merely comprised of gaskets 90 (and a gasket 92 may further be used with coupling collar 81, as shown) but alternatively such connecting means 30 may be a configuration wherein mutually opposite ends of inner pipe members 14, 14' overlap as shown in FIG. 2 and as described in regard thereto.

Figure 5:
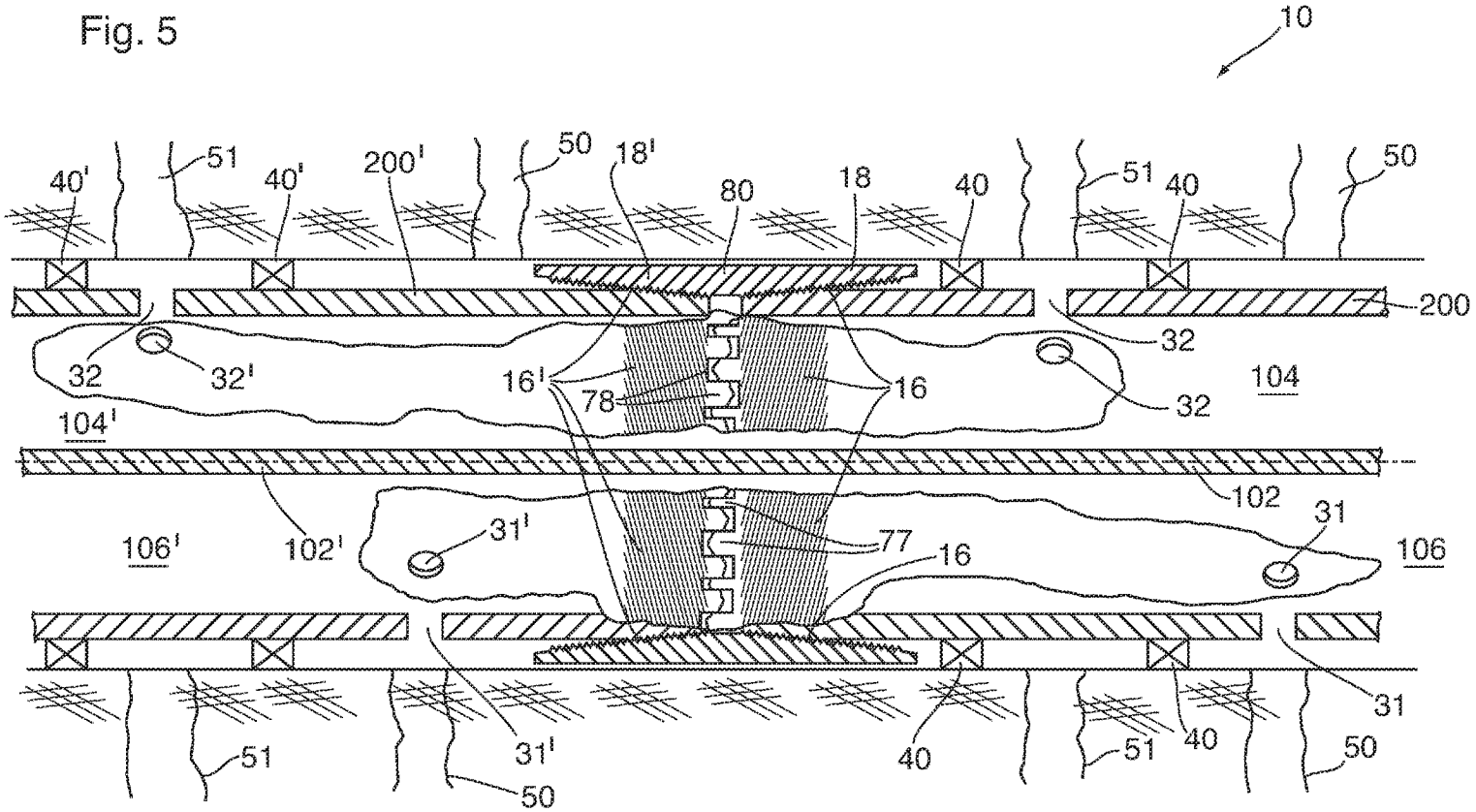
FIG. 5 is a cross-sectional view of a second embodiment of a multi-flow (in this case dual flow) pipe assembly which employs divided flow passages, taken through a pair of multi-flow pipe assemblies when coupled together.

FIG. 5 shows a different alternative embodiment of the multi-flow pipe assembly 10 of the present invention, of the "divided pipe" configuration.

Each pipe member 200, 200' has a longitudinal hollow bore extending substantially along a length thereof, which by means of a flat divider partition 102, 102' typically welded into the bore of pipe members 200, 200' divides the bores of respective pipe members 200, 200' into a first flow passage 104, 104' and a second separate flow passage 106, 106' respectively.

A first plurality of apertures 32, 32' are provided in an outer periphery of multi-flow pipe assembly 10, situated along at least a portion of a length of said multi-flow pipe assembly 10, and which when said pipe members 200, 200' are coupled together provide fluid communication between an exterior of said multi-flow pipe assembly 10 and said first flow passage 104, 104', respectively.

A second plurality of apertures 31, 31' are provided respectively in pipe members 200, 200' in an outer periphery thereof, alternately spaced with said first plurality of apertures 32, 32' and situated in and longitudinally along said outer periphery of multi-flow pipe assembly 10. Apertures 31, 31' provide fluid communication between an exterior of said multi-flow pipe assembly 10 and said second flow passage 106, 106', respectively.

Packer elements 40, 40' encircling the outer periphery of said multi-flow pipe assembly are provided. Packer elements 40, 40' are positioned between respective pairs of first apertures 31, 31' and second apertures 32, 32' as shown in FIG. 5.

Alignment means 77, situated at opposite ends of each of said pipe members 200, 200', are provided, and are adapted to engage corresponding mating alignment means at an opposite end of pipe members 200, 200' when said pipe members 200, 201' are in end-to-end abutting relationship and ensure said divider partition 102, 102' of respective pipe members 200, 200' are in substantial coplanar relationship so that channel 104 is aligned with channel 104' and likewise channel 106 is aligned with channel 106' when two pipe members 200, 200' are coupled together, in the manner below described.

Coupling of pipe members 200, 200' in the embodiments shown in FIG. 5 is effected by way of a coupling collar 80, which threadably engages mutually opposite ends of each of pipe members 200, 200' in the manner described in regard to coupling of the embodiment of the pipe-in-pipe configuration described in FIG. 2, but with the added important feature of simultaneously effecting such coupling causing, by means of the alignment means 77, the pipe members 200, 200' to be coupled with the channels 104, 104' and 106, 106' aligned and with the divider partition in each also aligned.

Coupling collar 81 is provided with a pair of internal helical threads 16, 16', each of 'opposite hand' threads. Thus coupling collar 81, when rotated in one direction, in combination with said mating alignment means 77, draws together mutually opposite ends of said pipe members 200, 200' such that said divider partition 102 in respective pipe member 200 abuts (save and except for the interposition of gasket 140) and is in substantial coplanar relationship with divider portion 102' of pipe member 200'.

Alignment means 77, which is critical in ensuring alignment of channels 104, 104' and 106,106', may comprise a series of tongue-and-groove indentations 78 in respective pipe members 200,200', which only interdigitate (i.e. engage) upon correct alignment of channels 104, 104' and 106, 106' within respective pipe members 200, 200', as shown in FIG. 5.

Figure 6:
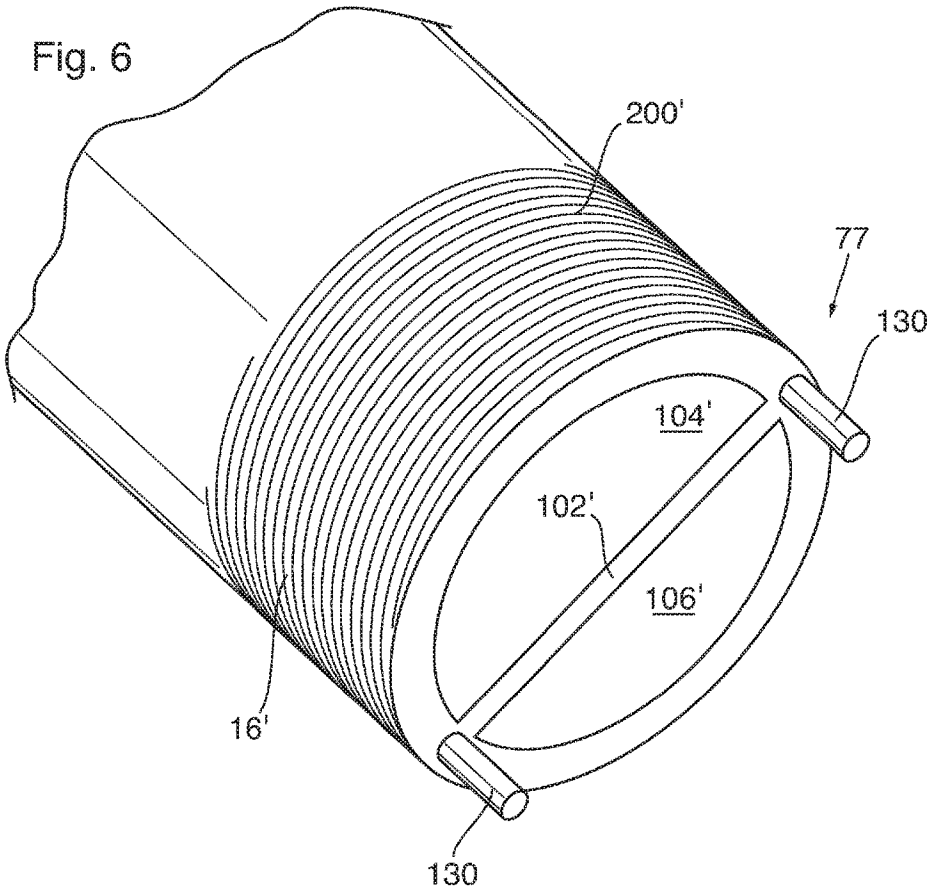
FIG. 6 is a perspective view of one end of a pipe member having a divider partition, showing an alignment dowel for use in aligning the divider partition of an adjoining pipe member with that of the pipe member shown.
Figure 7:
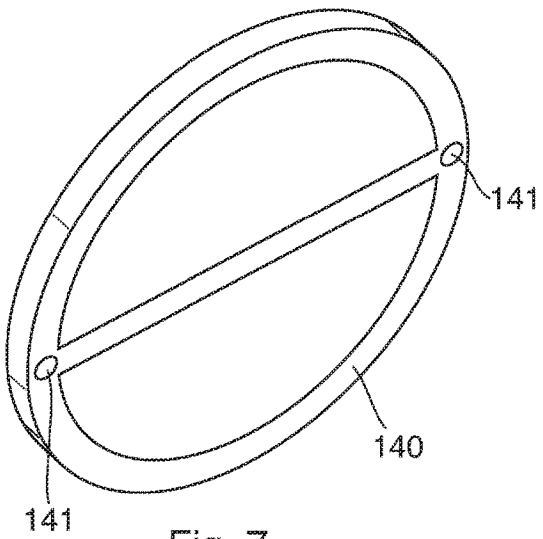
FIG. 7 is a perspective view of a gasket member, which may be placed between to pipe members each having a divider partition to ensure no leakage of fluid between flow passages on mutually opposite sides of the divider partition(s) at the junction (joint) between two multi-flow pipe members.

In another embodiment alignment means 77 may comprise a dowel or pair of dowels 130 situated on one end of pipe member 200, as shown in FIG. 6, which matingly engage a correspondingly located pair of receptacles (not shown) situated on a mutually opposite ends of each pipe member 200, 200', so as to align each divider partition 102, 102' and each of channels 104, 104' and 106, 106' when pipe members 200, 200' are coupled together. A gasket 140 is provided, with apertures 141 therein to provide for dowels 130 as shown in FIG. 7. Gasket 140 is placed between pipe members 200, 200' when coupled together to provide sealing between pipe members 200, 200' and further between divider portions 102, 102' thereof. The embodiment using dowels 130 as alignment means, although not apparent from FIG. 8, is the alignment means 77 used in such depicted configuration of multi-flow pipe assembly 10 to align the flow channels 104,104' and 106, 106' when pipe members 200, 200' are coupled together.

Figure 8:
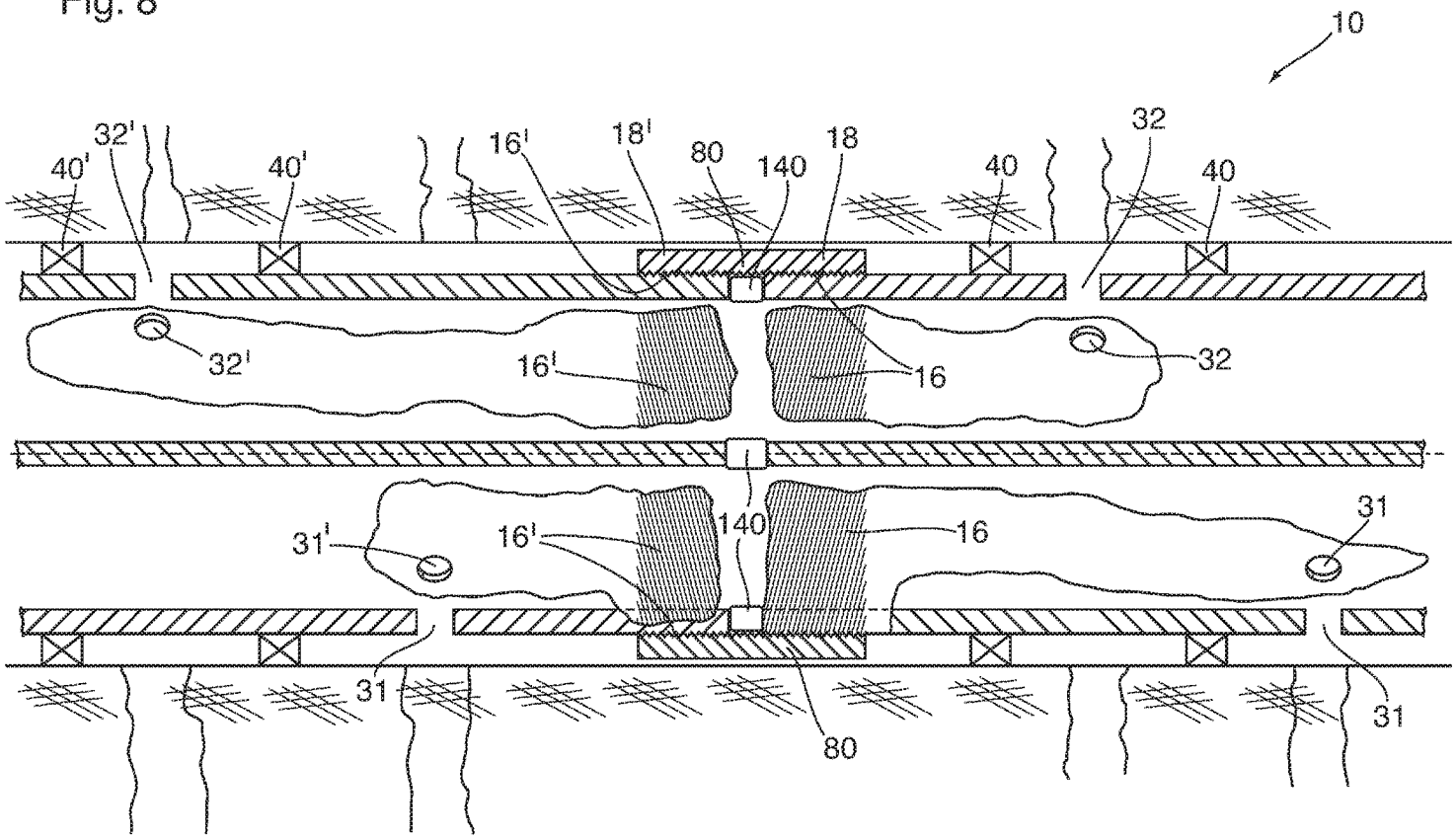
FIG. 8 is a cross-sectional view of a refinement of a multi-flow (in this case dual flow) pipe assembly which employs divided flow passages, taken through a pair of pipe assemblies when coupled together.

In such embodiment, and as shown in FIG. 8, coupling of pipe members 200, 200' is again achieved with similar components with regard to the embodiment shown in FIG. 5, and in particular by a coupling collar 80. Opposite ends of pipe members 200, 200' are provided with external, oppositely handed external helical threads 16, 16' respectively. Collar 80 is again provided with a similar pair of mating internal helical threads 18, 18', each likewise of opposite hand. When dowels 141 are aligned with corresponding receptacles on opposite end of pipe members 200, 200', coupling collar 80 is rotated in one direction and by virtue of the oppositely-handed threads 16, 16' and 18, 18' draws each of pipe members 200, 200' together, compressing gasket 140 to effect a seal. Flow channels 104,104' and 106, 106' are each thus aligned respectively with each other, and sealingly isolated from each other, and a multi-flow pipe assembly 10 is thus formed.

Figure 9B:
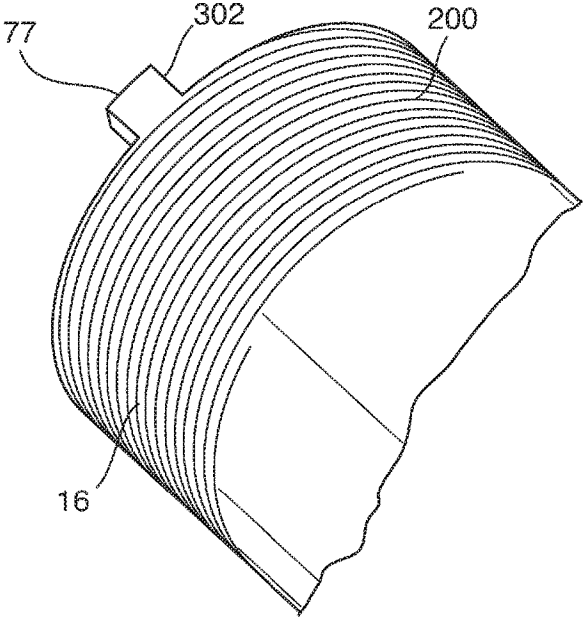
FIG. 9B is a perspective view of the opposite end of the pipe member shown in FIG. 9A, namely at the end of such pipe member having and alignment protuberance adapted to matingly engages the alignment notch shown in FIG. 9A.
Figure 9A:
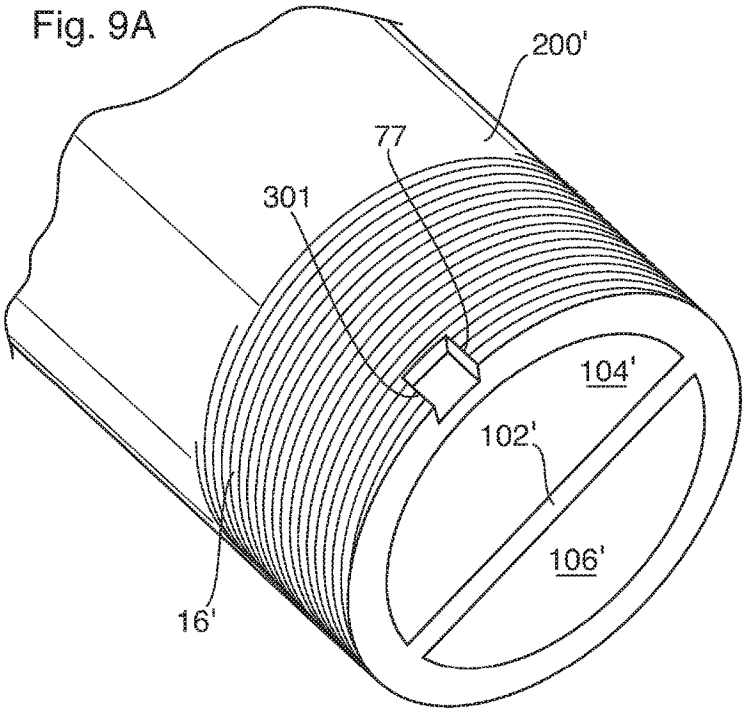
FIG. 9A is a perspective view of one end of a pipe member having a divider partition, showing an alignment notch for use in aligning the divider partition of an adjoining pipe member (shown in FIG. 9B) with that of the pipe member shown in FIG. 9A.

FIGS. 9A, 9B show another alternative embodiment of the alignment means 77, which may be alternatively used in the embodiment of the invention shown in FIG. 8. In such embodiment alignment means 77 may alternatively comprise a protuberance 302 at one end of pipe member 200, and on an opposite end (ie. on end shown in FIG. 9A in regard to pipe member 200') a mating notch or receptacle 301 may be provided. In such manner pipe members 200 and 200' can only be coupled together, by means of the coupling collar 80 as shown in FIG. 8 if flow channels 104,104' and 106, 106' are each aligned respectively with each other to form a coupled multi-flow pipe assembly 10.

The foregoing description of the disclosed embodiments is provided to enable any person skilled in the art to make or use the present invention. The scope of the claims should not be limited by the preferred embodiments set forth in the examples, but should be given the broadest interpretation consistent with the description as a whole. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". In addition, where reference to "fluid" is made, such term is considered meaning all liquids and gases having fluid properties, as well as semi-solids such as tar-like substances.

For a complete definition of the invention and its intended scope, reference is to be made to the summary of the invention and the appended claims read together with and considered with the disclosure and drawings herein.

I claim:

1. A duel-flow pipe assembly, having a plurality of outer and inner pipe members coupled together in end-to-end relation for delivery downhole of a first fluid to a hydrocarbon-containing formation and collection from the formation of a separate second fluid, said dual-flow pipe assembly maintaining separate therewithin said first fluid from said second fluid, each dual-flow pipe member of said dual flow pipe assembly comprising:

an outer cylindrical hollow pipe member, having a threaded portion at opposite ends thereof for threaded coupling to another outer pipe member;

an inner cylindrical pipe member having a hollow bore, said inner pipe member situated within said outer pipe member so as to form an annular region between an exterior of said inner pipe member and an interior surface of said outer hollow pipe member, said inner cylindrical pipe member having at mutually opposite ends thereof connecting means to sealingly engage and/or connect to another inner pipe member;

a plurality of apertures in a periphery said outer pipe member, situated in spaced-apart relation along at least a portion of a length of said outer pipe member, providing fluid communication between an exterior of said outer pipe member and said annular region;

a packer element encircling said outer pipe member about said periphery of said outer pipe member and positioned on said periphery between a pair of said plurality of apertures; and at least one tubular member, situated within at least one of said spaced-apart apertures, affixed at one end thereof to said periphery of said outer pipe member and affixed at another mutually opposite end to said inner pipe member and spanning in a radial direction said annular region and providing fluid communication between said exterior of said outer pipe member and said bore of said inner pipe member.

2. The dual-flow pipe assembly as claimed in claim 1, said dual-flow pipe assembly comprising a plurality of said tubular members, located in alternately-spaced apertures of said plurality of apertures, along substantially a length of said outer pipe member of said dual flow pipe assembly, which support and fixedly retain said inner pipe member within said outer pipe member.

3. The dual-flow pipe assembly as claimed in claim 2, wherein at least some of said alternately-spaced apertures are threaded, and at least some of said tubular members are threadably coupled to said interior pipe member via insertion in respective of said threaded alternately-spaced apertures.

4. The dual flow pipe assembly as claimed in claim 2 or 3, wherein at least some of said tubular members, at an extremity thereof, are welded to said outer pipe member.

5. The dual-flow pipe assembly as claimed in claim 1, wherein said threaded portion on said outer pipe member comprises at one end of said outer pipe member an externally threaded portion.

6. The dual-flow pipe assembly as claimed in claim 5, wherein said threaded portion on said outer pipe member, at a mutually opposite other end of said outer pipe member, comprises an internally threaded portion.

7. The dual flow pipe assembly as claimed in claim 5 or 6, wherein each of said externally threaded portion and said internally threaded portion on said outer pipe member each comprise a frusto-conical thread.

8. The dual flow pipe assembly as claimed in claim 5, wherein said threaded portion on said outer pipe member, at a mutually opposite other end of said outer pipe member, also comprises an externally threaded portion; and wherein each of said externally threaded portions on said outer pipe member each comprises a frusto-conical thread, and said dual-flow pipe member when coupled to another dual-flow pipe member further comprises:

(i) a coupling collar, having a pair of internal, mutually oppositely threaded, conical threaded portions, configured to threadably engage each of said external threads on respective opposite ends of said outer pipe members such that rotation of said collar in a first direction draws together said ends of said outer pipe members.

9. The dual-flow pipe assembly as claimed in claim 8, further comprising matingly-engageable splines at each end of said outer pipe member, wherein rotating said collar in said first direction draws together said ends of said outer members and further causes mating engagement of said splines so as to rotatably lock one of said dual-flow pipe members relative to another of said dual-flow pipe members.

10. The dual flow pipe assembly as claimed in claim 5, said end of said outer pipe member opposite said threaded end further comprising a coupling collar, said coupling collar having an internal threaded portions, configured to threadably engage said external threads at said one end of said pipe member, such that rotation of said collar in a first direction draws together said ends of said outer pipe members.

11. The dual-flow pipe assembly as claimed in claim 1, wherein said connecting means comprises helically threaded portions on mutually opposite ends of said inner pipe member.

12. The dual-flow pipe assembly as claimed in claim 1, 8, or 11 wherein said connecting means comprises a gasket member which is compressed between opposite ends of a pair of said inner pipe members.

13. The dual-flow pipe assembly as claimed in claim 1, 8, or 11 wherein said connecting means comprises mutually overlapping ends of a pair of said inner pipe members.

14. A plurality of cylindrical multi-flow pipe members threadably coupled together in end-to-end relation to form a multi-flow pipe assembly, for delivering downhole a first fluid to a hydrocarbon-containing formation and collecting from the formation a separate second fluid, said pipe members each maintaining separate therewithin said first fluid from said second fluid, each pipe member having a longitudinal hollow bore extending substantially a length thereof, further having extending throughout said bore at least one substantially flat divider partition, said divider partition dividing said bore longitudinally into a first flow passage and a second separate flow passage;

a first plurality of apertures in an outer periphery of said multi-flow pipe assembly, situated along at least a portion of a length of said multi-flow pipe assembly, and which when said pipe members are coupled together provide fluid communication between an exterior of said multi-flow pipe assembly and said first flow passage;

a second plurality of apertures in said outer periphery of said multi-flow pipe assembly, alternately spaced with said first plurality of apertures in and longitudinally along said outer periphery, providing fluid communication between an exterior of said multi-flow pipe assembly and said second flow passage;

packer elements encircling said outer periphery of said multi-flow pipe assembly and positioned between respective pairs of first apertures and second apertures;

alignment means, situated at opposite ends of each of said pipe members, adapted to engage corresponding mating alignment means at an opposite end of another pipe member when said pipe members are in end-to-end abutting relationship and ensure said divider partition in each of said pipe members is in substantial coplanar relationship with an adjacent of said divider partition of another pipe member coupled thereto; and couplings means, at mutually opposite ends of each of said pipe members, which, in combination with said mating alignment means, draws together mutually opposite ends of said pipe members such that said divider partition in each of said pipe members abuts and is in substantially coplanar relationship with, said divider portion of another pipe member coupled thereto.

15. The plurality of cylindrical multi-flow pipe members coupled together in end-to-end relation to form a multi-flow pipe assembly as claimed in claim 14, wherein said coupling means comprises:

an externally threaded portion situated at mutually opposite ends of each of said pipe members, each of said externally threaded portions on each pipe member being mutually oppositely threaded; and a plurality of coupling collars, having a pair of internal, mutually oppositely threaded, portions, configured to threadably engage each of said external threads on opposite ends of said pipe members, such that rotation of said collars in a first direction draws together respective of said ends of a pair of said outer pipe members and further causes mating engagement of said mating alignment means to prevent relative angular rotation between coupled pipe members.

16. The plurality of elongate cylindrical multi-flow pipe members coupled together in end-to-end relation to form a multi-flow pipe assembly as claimed in claim 15, wherein:

said externally threaded portions on each of said pipe members are frusto-conical; and said internal threaded portions on each of said coupling collars are correspondingly frusto-conical in shape.

17. The plurality of elongate cylindrical multi-flow pipe members coupled together in end-to-end relation to form a multi-flow pipe assembly as claimed in claim 14, wherein said coupling means comprises:

an externally threaded portion on one end of each of said pipe members;

a plurality of coupling collars, journalled for rotation at respective of said opposite ends of said pipe members, and further having an internally threaded portion therein;

wherein when said externally threaded portion at said one end of each of said pipe members abuts said mutually opposite end of said pipe members when same are coupled in end-to-end relation, said alignment means matingly engages said corresponding mating alignment means at an opposite end of another pipe member said coupling collar can be rotated so as to threadably engage said external threaded portion on said one end of said pipe members and retain said pipe members together.

18. The plurality of elongate cylindrical multi-flow pipe members coupled together in end-to-end relation to form a multi-flow pipe assembly as claimed in claim 14, further comprising a sealing gasket interposed between each pipe member, said sealing gasket configured to prevent leakage of fluid from said first flow passage to said second flow passage and vice versa when said pipe members are coupled together.

* * * * *